US009598206B2

(12) United States Patent
Boukobza et al.

(10) Patent No.: US 9,598,206 B2
(45) Date of Patent: Mar. 21, 2017

(54) CONTAINER INCLUDING AN ARCHED BOTTOM HAVING A SQUARE SEAT

(75) Inventors: Michel Boukobza, Octeville sur Mer (FR); Mikaël Derrien, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 150 days.

(21) Appl. No.: 13/703,184

(22) PCT Filed: Jun. 14, 2011

(86) PCT No.: PCT/FR2011/051338

§ 371 (c)(1),
(2), (4) Date: Feb. 28, 2013

(87) PCT Pub. No.: WO2011/154671

PCT Pub. Date: Dec. 15, 2011

(65) Prior Publication Data

US 2013/0153530 A1 Jun. 20, 2013

(30) Foreign Application Priority Data

Jun. 11, 2010 (FR) ..... 10 02486

(51) Int. Cl.
*B65D 1/06* (2006.01)
*B65D 23/00* (2006.01)
*B65D 1/02* (2006.01)

(52) U.S. Cl.
CPC ..... *B65D 23/001* (2013.01); *B65D 1/0261* (2013.01)

(58) Field of Classification Search
CPC ..... B65D 90/02; B65D 23/001; B65D 90/12; B65D 1/0261
USPC ..... 215/373, 376, 370; 220/609
See application file for complete search history.

(56) References Cited

U.S. PATENT DOCUMENTS 4,515,284 A * 5/1985 Lee, Jr. ..... B65D 1/165 220/606
4,525,401 A 6/1985 Pocock et al.
7,740,148 B2 * 6/2010 Rajagopalan ..... B65D 17/02 220/608

(Continued)

FOREIGN PATENT DOCUMENTS

EP 1 918 213 A1 5/2008
WO 2006/100374 A1 9/2006
WO 2010/061758 A1 6/2010

*Primary Examiner* — Anthony Stashick
*Assistant Examiner* — Raven Collins
(74) *Attorney, Agent, or Firm* — Sughrue Mion, PLLC

(57) ABSTRACT

The invention relates to a container made of a plastic material, provided with a body (5) and a bottom (6) extending at a lower end of the body (5), wherein the bottom (6) includes: an annular seat (7) extending substantially away from the body (5) and defining a support surface (8) and an inner annular flange (11) substantially perpendicular to the support surface; a concave arch (13) which extends from an area adjacent to the seat (7) towards a central area (14). The axial dimension H of the flange and the radial dimension L of the support surface are such that: formula (I).

$$0.6 \leq \frac{L}{H} \leq 1.5 \quad \text{(I)}$$

13 Claims, 5 Drawing Sheets

(56) References Cited

U.S. PATENT DOCUMENTS

| | | | | |
|---|---|---|---|---|
| 8,950,611 | B2 * | 2/2015 | Derrien | B65D 1/0276 215/373 |
| 2007/0125742 | A1 * | 6/2007 | Simpson et al. | 215/376 |
| 2009/0159556 | A1 * | 6/2009 | Patcheak et al. | 215/373 |
| 2009/0218308 | A1 | 9/2009 | Bunel et al. | |
| 2009/0283494 | A1 | 11/2009 | Maxwell | |

* cited by examiner

CONTAINER INCLUDING AN ARCHED BOTTOM HAVING A SQUARE SEAT

The invention relates to the manufacture of containers, such as bottles or jars, obtained by blowing or stretch-blowing preforms made of thermoplastic material.

The manufacture of a container by blowing generally consists of inserting a blank (a term designating either a preform or an intermediate container obtained by pre-blowing a preform) into a mould with the shape of the container, said blank having previously been heated to a temperature above the glass transition temperature of the material, and of injecting a gas (such as air) under pressure into the blank. The blowing can be supplemented by a prior stretching of the blank by means of a slide rod.

The dual molecular orientation that the material undergoes during blowing (axial and radial, respectively parallel and perpendicular to the general axis of the container) gives the container a certain structural rigidity.

However, the reduction—dictated by the market—of the quantity of material used for manufacturing containers requires manufacturers to resort to contrivances of manufacturing or shape to rigidify their containers, bi-orientation having proved to be insufficient. The result is that two containers of equal weight do not necessarily have the same mechanical performance (strength, rigidity).

One technical solution for enhancing the structural rigidity of a container consists of over-stretching the bottom of the container by means of a mould specially equipped with a mould bottom movable in translation that pushes back the material (in particular, see European patent EP 1 069 983). The over-stretching causes an increase in the rate of deformation of the material and thus a mechanical increase in its crystallinity.

However, this technique—called "boxing"—does not guarantee that the rigidity of the bottom will be satisfactory. This is the reason it is generally combined with contrivances of shape. However, all shapes are not acceptable because of the blowability limitations of the material ("blowability" is the capacity of the container to be formed by blowing, or in other words the capacity of the material to conform properly to the cavity of the mould).

A good compromise is therefore sought in the choice of parameters (particularly rigidity and blowability) that should be maximized, as well as those that should be minimized (particularly weight and blowing pressure).

To date, lightweight containers intended for ordinary applications (such as flat water) offer inadequate mechanical performance. In particular, it has been noted that even when the rigidity of a lightweight container seems sufficient during filling, palletization poses a problem because the weight of the stacked containers exerts stresses on the lower containers such that the bottoms tend to curl and the pallet to collapse.

An objective of the invention is to improve, for equal or lower weight, and preferably at equal or lower blowing pressure, the mechanical performance of a container, while maximizing its blowability.

To that end, the invention proposes a container of plastic material, having a body and a bottom extending at a lower end of the body, the bottom comprising:

- an annular seat extending substantially in the prolongation of the body and defining a seating plane and an annular cheek substantially perpendicular to the seating plane;
- a concave arch that extends from the zone near the seat to the central zone;

characterized in that the axial dimension H of the cheek and the radial dimension L of the seating plane are such that:

$$0.6 \leq \frac{L}{H} \leq 1.5$$

Such a container has increased stability and rigidity, thanks in particular to the combination of the wide seat (in the prolongation of the body) and of the square seat.

According to a particular embodiment, the axial dimension H of the cheek and the radial dimension L of the seating plane are such that:

$$0.8 \leq \frac{L}{H} \leq 1.2$$

The axial dimension of the cheek and the radial dimension of the seating plane are preferably substantially equal.

According to one embodiment, the container further comprises:

- a series of stiffeners that extend radially from the central zone to the seat;
- a junction face (which for example is in the shape of a truncated cone and has a predetermined angular opening) between the arch and the cheek;
- a peripheral series of curved surfaces projecting inwards from the junction face between the stiffeners and which can locally modify (by increasing or decreasing) the angular opening of the junction face.

According to a particular embodiment, each curved surface has an arched inner edge that overlaps the arch, and lateral edges that can be non-parallel.

Other objectives and advantages of the invention will be seen from the following description provided with reference to the appended drawings in which.

Figure 1:
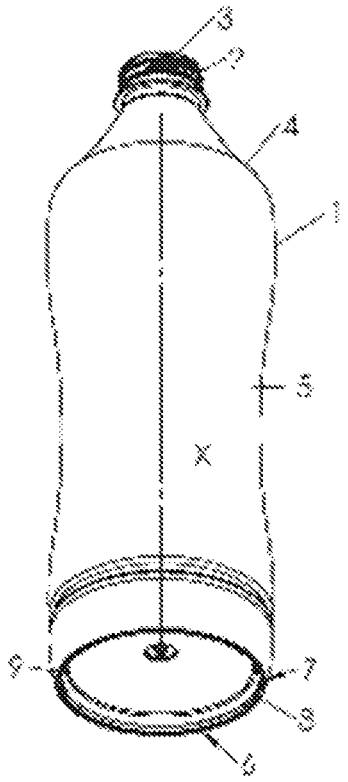
FIG. 1 is a view in perspective from below of a container of plastic material.

Represented in FIG. 1 is a container 1 produced by stretch-blowing a preform made of thermoplastic material such as PET (polyethylene terephthalate).

Said container 1 comprises, at an upper end, a threaded neck 2, provided with a mouth 3. In the prolongation of the neck 2, the container 1 comprises, in its upper part, a shoulder 4 that widens out in the opposite direction of the neck 2, said shoulder 4 being extended by a lateral wall or body 5, generally cylindrical in revolution around a principal axis X of the container 1.

The container 1 further comprises a bottom 6 that extends at a lower end of the container 1.

Figure 3:
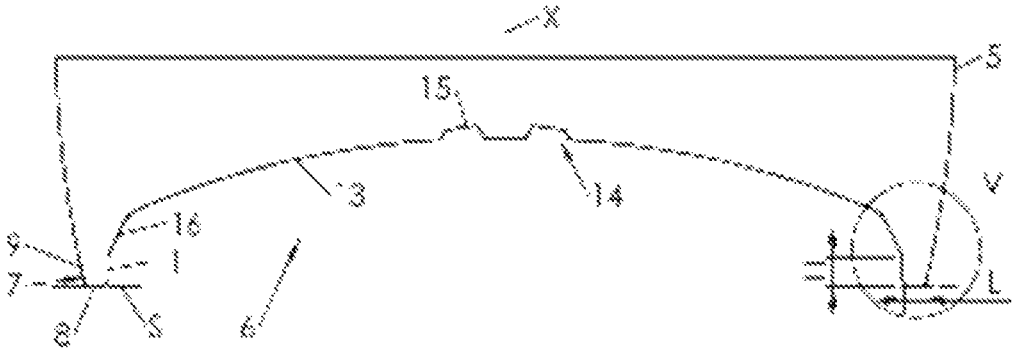
FIG. 3 is a cross-section of the bottom of the container of FIG. 2.

As can be seen in the drawings, the bottom 6 comprises a seat 7 in the shape of a thin annular bead that extends substantially axially in the prolongation of the body 5. The seat 7 is terminated by a continuous annular face that forms the lower end of the container 1 and defines a seating plane 8 perpendicular to the axis of the container 1, by which seating plane said container can be placed stably on a flat surface S (FIG. 3).

The seating plane 8 extends radially over a width L and connects outwardly to an outer lateral face 9 of the seat 7 (which extends in the prolongation of the body) by an outer fillet 10 of small radius, i.e. on the order of a millimeter.

Towards the interior of the container 1, the seat 7 comprises an annular cheek 11 that extends axially toward the interior of the container 1 in the prolongation of the seating plane 8, substantially at a right angle with respect thereto.

The seating plane 8 is connected inwardly to the cheek 11 by an inner fillet 12 preferably of small radius of curvature—equal to or less than about 1 mm.

The bottom 6 further comprises a concave arch 13 (with concavity turned towards the exterior of the container 1 in the absence of stress, i.e. in the absence of content in the container 1), which extends in the prolongation of the cheek 11 to a central zone 14 of the bottom 6.

As can be seen in FIG. 3, the arch 13 is not deep, and its curvature is not pronounced. The maximum angle A1 of its tangent with a plane perpendicular to the axis X of the container 1 (in this instance, measured on an outer edge of the arch 13) is small—equal to or less than about 21°.

In the central zone 14, the bottom 6 comprises, in the prolongation of the arch 13, a central pin 15 that projects axially towards the interior of the container 1.

As can be seen in the drawings, the arch 13 is not directly connected to the cheek 11, but through a junction face 16 generally in the shape of a truncated cone in revolution around the axis X of the container 1, whose angle A2 with a plane perpendicular to the axis X of the container 1 is between 31° and 70°.

The cheek 11 extends axially at a height H, with a ratio to the width L of the seating plane 8 of between 0.6 and 1.5:

$$0.6 \leq \frac{L}{H} \leq 1.5$$

Preferably, the ratio L/H is closer to 1, falling between 0.8 and 1.2:

$$0.8 \leq \frac{L}{H} \leq 1.2$$

The L/H ratio can even be made substantially equal to:

$$\frac{L}{H} \cong 1$$

Thus, in cross-section the seat 7 has a substantially square profile, as can be seen in FIGS. 4, 6, 9 and 12.

The result for the container 1 is, on the one hand, good rigidity and good stability during filling as well as palletization, and, on the other hand, good blowability.

Tests have shown that the rigidity of the bottom 6 is optimal when the cheek 11 and the seating plane 8 have dimensions, respectively axial and radial, which are similar, as explained above.

Indeed, the rigidity is best when these dimensions are substantially equal, but the performance offered by an L/H ratio between 0.6 and 1.5 is good.

Moreover, because the diameter of the seating plane 8 is substantially equal to that of the body 5 near the bottom 6, the wide seat 7 combined with a small radius of the outer fillet 10 produces better stability for the container 1 than a conventional seat with a seating plane diameter substantially smaller than the diameter of the body, and the large radius fillet promotes the curling of the bottom.

The container 1 can be manufactured by stretch-blowing a preform made of plastic such as PET. For the formation of the body 6, a boxing operation is advantageously used.

Various particular embodiments, having all of the characteristics described above but differing depending on the geometry of the arch and/or seat, will now be described in greater detail.

Figure 2:
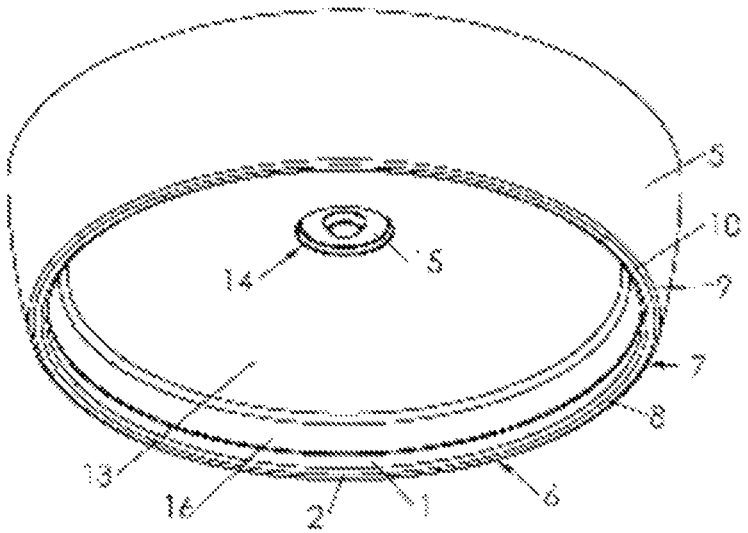
FIG. 2 is a view in perspective, in larger scale, showing the bottom of the container of FIG. 1 according to a first embodiment.
Figure 4:
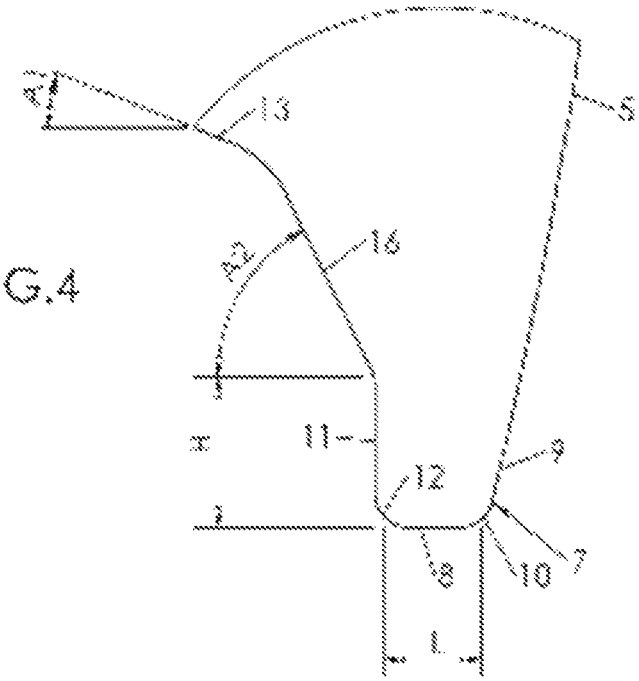
FIG. 4 is a detail of the cross-section of the bottom, according to insert IV of FIG. 3.

In a first embodiment, illustrated in FIGS. 2, 3 and 4, it can be seen that the arch 13 is smooth and is in the shape of a spherical cap.

The L/H ratio is about 0.68:

$$\frac{L}{H} \cong 0.68$$

The junction face 16 is smooth, and is limited to a truncated cone whose angle A2 is relatively pronounced, its value being about 65°, thus giving good structural rigidity near the seat 7.

The relative simplicity of shape of the bottom 6 gives it good blowability, which makes it possible to blow the container 1 at a moderate pressure, less than or equal to about 25 bars.

In a second embodiment, illustrated in FIGS. 5 to 13, the arch 13 is provided with a series of stiffeners 17 in the form of projecting branches that extend radially from the central zone 14 of the bottom 6 to the cheek 11, and which together form a star motif.

In this embodiment, the stiffeners 17 are connected to the central zone 14 of the bottom 6 by an inner radial end 18 and are connected to the cheek 11 by an outer radial end 19. In the illustrated examples, there are 8 stiffeners 17, but this number is provided by way of example and could be different. More precisely, this number can be between 4 and 12. For purposes of mechanical strength, it is preferably between 6 and 10. Similarly, the height, width and shape of the stiffeners 17 can vary depending on the applications. The stiffeners 17 can be straight or arched in a Y shape pointing either towards the center or towards the periphery of the bottom, or they can be X-shaped. In the illustrated examples, the stiffeners 17 have a reverse-Y profile, and over about one half of their length have a straight I-shaped inner portion 20, of substantially constant width, which is extended by a reverse V-shaped outer portion 21 that widens from the inner portion 20 towards the outer end 19.

In the interstices between the stiffeners 17, the arch 13 defines indented panels 22, the profile of which is complementary to that of the stiffeners 17.

Each stiffener 17 has a concave lower face 23 which extends in the prolongation of the surface of the central zone 14, and two lateral edges 24 that form fillets 25, 26 that connect the lower face 23 with the indented panels 22. As can be clearly seen in FIGS. 5, 8 and 11, the edges 24 have a double radius and comprise a first fillet 25 with convex profile, flush with the lower face 23, followed by a second fillet 26 with concave profile, flush with the panel 22.

The central zone 14 of the bottom 6 is reduced at the pin 15, which around its perimeter delimits the inner ends 18 of the stiffeners 17. As can be seen in FIG. 14, the pin 15 has a star-shaped profile, the inner ends 18 of the stiffeners 17 being thin and beveled.

Figure 5:
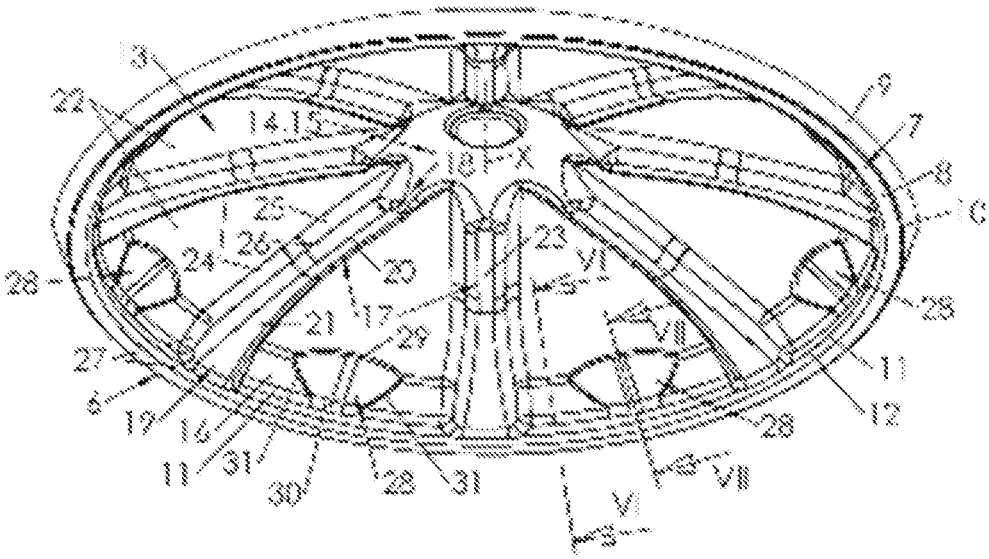
FIG. 5 is a view in perspective, similar to FIG. 2, illustrating a second embodiment of the bottom of the container.
Figure 8:
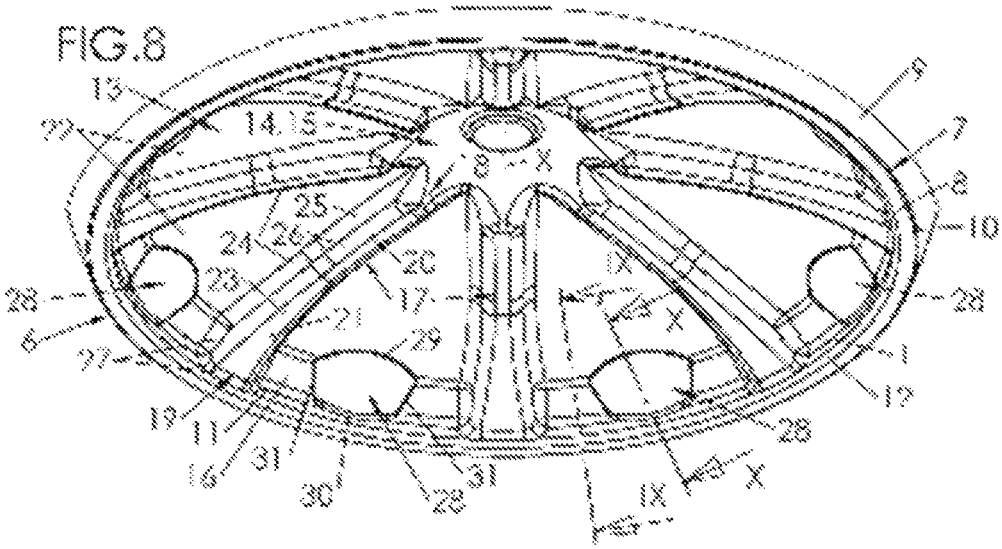
FIG. 8 is a view in perspective, similar to FIG. 5, illustrating a variant of embodiment of the bottom of the container.
Figure 11:
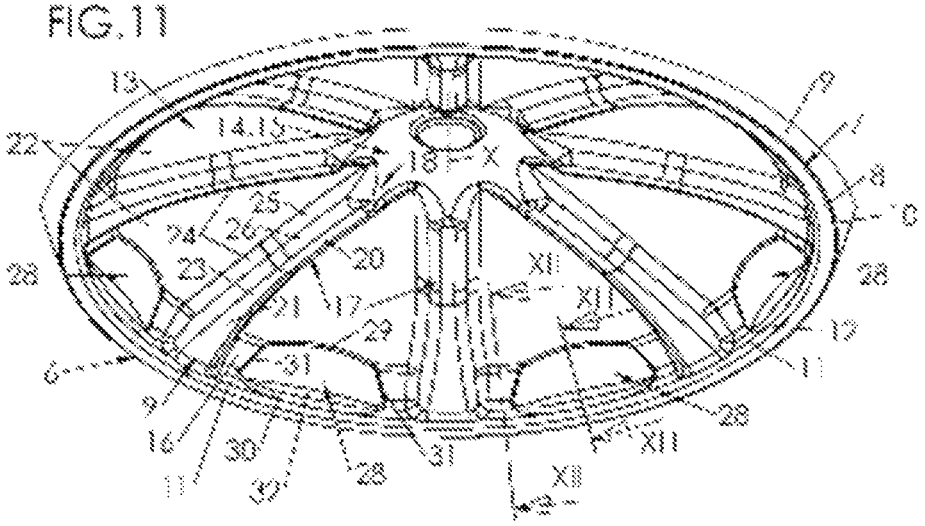
FIG. 11 is a view in perspective, similar to FIG. 5, illustrating another variant of embodiment of the bottom of the container.

As can be seen in FIGS. 5, 8 and 11, in order to improve the blowability of the bottom 6, fillets 27 are provided at the outer ends 19 of the stiffeners, to ensure their connection with the junction face 16, on the one hand, and with the cheek 11, on the other hand.

The L/H ratio is substantially equal to one:

$$\frac{L}{H} \cong 1$$

Moreover, the bottom 6 is reinforced by a peripheral series of curved surfaces 28, each of which is formed to project radially inwards, on the junction face 16 between the cheek 11 and the arch 13, between the outer ends 19 of two adjacent stiffeners 17. The curved surfaces 28 are convex towards the axis X of the container 1 and locally reverse the curvature of the face 16. The curved surfaces 28 also have the effect of locally modifying the angular opening A2 of the face 16.

As can be seen in FIGS. 5, 8 and 11, each curved surface 28 has a substantially trapezoidal contour, and comprises:

- an arched inner edge 29 that projects with respect to the face 16 towards the axis X, and overlaps the arch 13 (more specifically the panel 22);
- an outer edge 30 that extends to the limit between the cheek 11 and the face 16 (in the embodiments of FIGS. 5 and 8), or overlaps the cheek (in the embodiment of FIG. 11); the outer edge 30 can be straight (FIG. 5) or arched outwards from the container 1 (FIGS. 8 and 11);
- two non-parallel lateral edges 31 that extend diverging from each other in a substantially radial direction across the face 16, either from the exterior towards the interior of the container 1 (in the embodiments of FIGS. 5 and 8), or in reverse from the interior towards the exterior (in the embodiment of FIG. 11).

Figure 6:
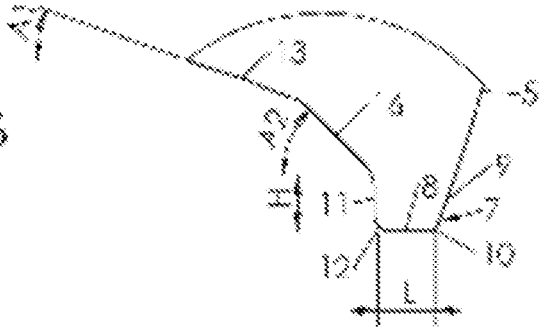
FIGS. 6 and 7 are detail views in cross-section, respectively along the cutting planes VI-VI and VII-VII of FIG. 5.
Figure 7:
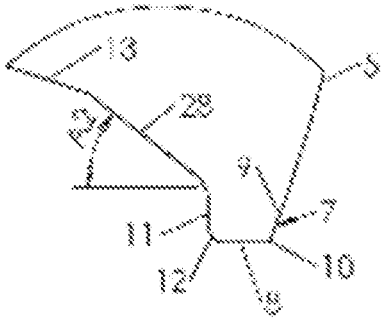

In the embodiment of FIGS. 5, 6 and 7, the two lateral edges 31 diverge from each other towards the interior of the container 1, and form an angle of about 90°.

As can be seen by comparing the cross-sections of FIGS. 6 and 7, the effect of the curved surface 28 is to rather sharply reduce the angular opening A2 of the face 16: from about 45° at the exterior of the curved surface 28 (FIG. 6), the angle A2 is about 35° in a median radial plane to the curved surface 28 (corresponding to the cutting plane VII-VII).

Figure 9:
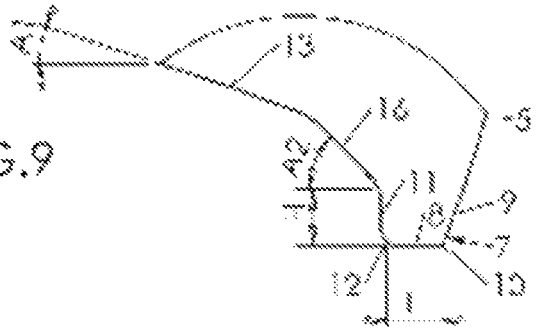
FIGS. 9 and 10 are detail views in cross-section, respectively along the cutting plane IX-IX and X-X of FIG. 8.
Figure 10:
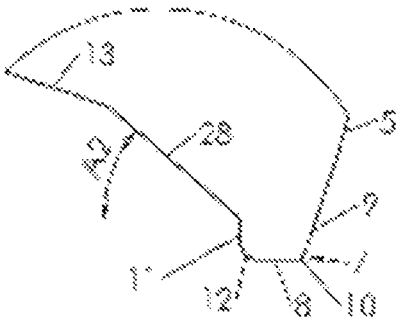

In a variant, illustrated in FIGS. 8, 9 and 10, the lateral edges 31 diverge from each other towards the interior of the container 1 and form a closed angle, less than 45° (in this instance about 31°). As can be seen in FIG. 8, the outer edge 30, arched toward the exterior of the container 1, at least partially overlaps the cheek 11.

As can be seen by comparison of the cross-sections of FIGS. 9 and 10, the effect of the curved surface 28 is to somewhat reduce the angular opening A2 of the face 16: from about 45° at the exterior of the curved surface 28 (FIG. 9), the angle A2 is about 40° in a median radial plane to the curved surface 28 (corresponding to the cutting plane X-X).

Figure 12:
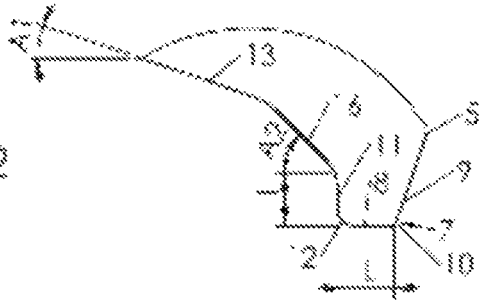
FIGS. 12 and 13 are detail views in cross-section, respectively along cutting planes XII-XII and XIII-XIII of FIG. 11.
Figure 13:
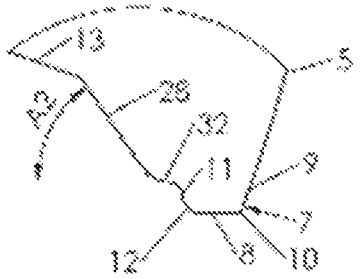

In another variant, illustrated in FIGS. 11, 12 and 13, the lateral edges 31 diverge from each other towards the exterior of the container 1, and form an angle of about 60°.

It can be seen in FIG. 11 that the outer edge 31 of the curved surface 28 extends nearly entirely over the cheek 11. Moreover, as can be seen in FIGS. 11 and 13, the curved surface 28 has, along its outer edge 31, a recess 32, so that the curved surface 28 has the effect of rather sharply increasing the angular opening A2 of the face 16: from about 45° at the exterior of the curved surface (FIG. 12), the angle A2 is about 55° in a median plane to the curved surface 28 (corresponding to the cut plane XIII-XIII).

In this second embodiment, the presence of the stiffeners 17 increases the rigidity of the arch 13, and decreases the risk of collapse of the bottom 6 under the effect of a load such as the kind to which palletized containers are subject.

Furthermore, as a result of their shape the stiffeners 17 act as knee braces, providing radial absorption of the axial stresses exerted on the arch 13 by the hydrostatic pressure of the contents of the container 1. The stiffeners 17 are supported against the cheek 11 at their ends, the radial absorption of the stresses resulting in a permanent centrifugal radial stress exerted by the stiffeners 17 on the seat 7 via the cheek 11, which contributes to rigidifying the seat 7, while preventing its ovalization.

The curved surfaces 28 have two principal functions. A first function of the curved surfaces 28 is to increase the rigidity of the bottom at the junction between the arch 13 and the seat 7 between the stiffeners 17; a second function is to compensate for the decreased blowability of the bottom 6 due to the presence of the stiffeners 17.

Indeed, during the moulding of the bottom 6, the material first reaches the cavities corresponding to the lateral edges 24 of the stiffeners 17, where it has a tendency to solidify locally before reaching the seat 7.

This results, during the moulding of the bottom, in tension of the material between the stiffeners 17 at the junction face 16 and the seat 7. As a result of the local inversion of the curvature of the junction face 16 and of the offset generated by the recess 32, the presence of the curved surfaces 28 facilitates the moulding of the material between the stiffeners 17 at the face 16 as well as at the seat 7.

Thus, the blowing pressure can be maintained at a value of less than 28 bars, and in practice between 20 bars and 28 bars.

The invention claimed is:

1. A container of plastic material, having a body extending along a longitudinal axis and a bottom at a lower end of the body, the bottom comprising:

- an annular seat extending substantially in the prolongation of the body and terminated by a continuous annular face that forms the lower end of the container and defines a seating plane perpendicular to the longitudinal axis of the container by which seating plane the container can be stably placed on a flat surface, and an inner annular cheek substantially perpendicular to the seating plane;
- a concave arch that extends from the zone near the seat to the central zone;

wherein an axial dimension H of the cheek and a radial dimension L of the seating plane are such that:

$$0.6 \leq \frac{L}{H} \leq 1.5,$$

wherein the seating plane connects to an outer lateral face of the seat by an outer fillet of small radius, the seating plane connecting to the cheek by an inner fillet of small radius of curvature; and wherein the container comprises:

a series of stiffeners that extend radially from the central zone to the seat, a junction face between the arch and the cheek, a peripheral series of curved surfaces projecting inwards from the junction face between the stiffeners, the arch being connected to the cheek through the junction face in the shape of a truncated cone in revolution around the longitudinal axis.

2. The container according to claim 1, characterized in that the axial dimension H of the cheek and the radial dimension L of the seating plane are such that:

$$0.8 \leq \frac{L}{H} \leq 1.2.$$

3. The container according to claim 1, characterized in that the axial dimension of the cheek and the radial dimension of the seating plane are substantially equal.

4. The container according to claim 1, characterized in that the junction face is a truncated cone and has a predetermined angular opening.

5. The container according to claim 4, characterized in that each curved surface locally modifies the angular opening of the junction face.

6. The container according to claim 5, characterized in that each curved surface locally reduces the angular opening of the junction face.

7. The container according to claim 5, characterized in that each curved surface locally increases the angular opening of the junction face.

8. The container according to claim 1, characterized in that each curved surface has an arched inner edge that overlaps the arch.

9. The container according to claim 1, characterized in that each curved surface has lateral edges that are non-parallel.

10. The container according to claim 1, wherein the outer fillet has a radius on an order of a millimeter.

11. The container according to claim 1, wherein the radial dimension L corresponds to a radial annular width of the annular face of the seat that is planar and that, when the container is placed upright on a flat support surface, contacts the flat surface support along the planar annular face.

12. A container of plastic material, having a body extending along a longitudinal axis and a bottom at a lower end of the body, the bottom comprising:

an annular seat extending substantially in the prolongation of the body and terminated by a continuous annular face that forms the lower end of the container and defines a seating plane perpendicular to the longitudinal axis of the container so that the container can be stably placed on a flat surface, and an inner annular cheek substantially perpendicular to the seating plane;

a concave arch that extends from the zone near the seat to the central zone;

wherein an axial dimension H of the cheek and a radial dimension L of the seating plane are such that:

$$0.6 \leq \frac{L}{H} \leq 1.5,$$

wherein the seating plane connects to an outer lateral face of the seat by an outer fillet, the seating plane connecting to the cheek by an inner fillet; and wherein the container comprises:

a series of stiffeners that extend radially from the central zone towards the seat, a junction face between the arch and the cheek, a series of spaced curved surfaces projecting radially inwards from the junction face and located between the stiffeners, the arch being connected to the cheek through the junction face in the shape of a truncated cone in revolution around the longitudinal axis.

13. The container according to claim 12, wherein the outer fillet and the inner fillet each is defined by a radius on the order of a millimeter.

* * * * *